United States Patent [19]

Scherer et al.

[11] Patent Number: 4,795,363

[45] Date of Patent: Jan. 3, 1989

[54] INSULATED TERMINAL AND MODULE

[75] Inventors: Richard J. Scherer, Austin; William G. Witt, Georgetown, both of Tex.

[73] Assignee: Minnesota Mining and Manufacturing Company, St. Paul, Minn.

[21] Appl. No.: 132,270

[22] Filed: Dec. 14, 1987

[51] Int. Cl.[4] ..... H01R 4/24

[52] U.S. Cl. ..... 439/395; 439/409

[58] Field of Search ..... 439/389, 390, 391, 392, 439/395, 398, 399, 400, 401, 409, 434

[56] References Cited

U.S. PATENT DOCUMENTS

| | | | |
|---|---|---|---|
| 4,283,105 | 8/1981 | Ferrill et al. | 439/406 |
| 4,341,430 | 7/1982 | Cranford | 439/409 |
| 4,431,247 | 2/1984 | Abdullah et al. | 439/392 |
| 4,541,679 | 9/1985 | Fiedler et al. | 439/395 |
| 4,637,675 | 1/1987 | Loose | 439/391 |
| 4,705,340 | 11/1987 | Loose | 439/395 |

FOREIGN PATENT DOCUMENTS

| | | | |
|---|---|---|---|
| 1795579 | 4/1986 | European Pat. Off. | 439/392 |

*Primary Examiner*—William R. Briggs

*Attorney, Agent, or Firm*—Donald M. Sell; John C. Barnes

[57] ABSTRACT

An electrical terminal having a supporting body, a tubular contact member having a bifurcate contact element and a cap enclosing the contact member with a wire receiving opening aligned with the contact element and a slotted opening aligned with a hole opposite the contact element. Contact is established by twisting the cap in relation to the contact member but only an inline connection is made as the wire is not severed simultaneously.

3 Claims, 3 Drawing Sheets

INSULATED TERMINAL AND MODULE

BACKGROUND OF THE INVENTION

1. Field of the Invention

This invention relates to electrical connectors, and in one particular aspect to a terminal useful at cross connect or serving area exchange points in communications systems, and more particularly to an improved cap for the terminals which affords wire connection at the terminal but will not cut the wire. Apparatus for the latter purpose typically includes terminals for 25 pairs of wires, arranged compactly in an array of rows and columns on a terminal block, for example as described in U.S. Pat. No. 4,431,247.

2. Description of the Prior Art

The existing terminal blocks as described in U.S. Pat. No. 4,431,247 serve to make a wire insulation displacement connection with the wire upon the twisting motion applied to the cap. The conductor to be connected extends through aligned holes in the cap and through an opening in a concentrically arranged stationary contact element which opening leads to an open mouthed wire receiving slot affording an insulation displacement connection (I.D.C.) with the wire of the conductor. The opposite side of the contact has a second opening through which the conductor extends which is initially aligned with a companion second opening in the cap. Turning the cap to make the wire connection forces the wire against the edges of the second opening resulting in the conductor being severed simultaneously with the wire connection or termination being made.

When it is desired to make connection with the contact and yet allow the conductor to extend beyond the terminal, this cutting is undesirable. It is therefore, a feature of the present invention to provide a replacement cap for a terminal which will permit tapping into the wire at the element and permit the conductor to b joined to another terminal, permanently or temporarily.

Two distinct uses are discovered for the improved cap. The extended end of the conductor placed through the cap in the terminal will afford temporary connection to the older telephone number assignment when making a connection to a new number. Then, the wire to the older number can be easily removed without another interruption in service to the new number.

Secondly, when making telephone extensions off-premises, a permanent connection featuring one wire will allow connection of the same phone number to two separate structures, such as a house and a garage or other outbuilding, or to an office and a laboratory within a single building.

SUMMARY OF THE INVENTION

An electrical terminal according to the present invention comprises a cylindrical contact member having an entry passage in one side forming an entrance to an insulation displacing wire receiving slot and perforation opposite said wire entry passage to form a wire exit passage, and a cap rotatable and generally coaxially associated with and surroundingly telescopically receiving said cylindrical contact member and having an opening aligned with the entry passage and a peripherally extending slotted opening aligned axially with the exit passage to afford relief of the wire from the edges of the exit passage. In a preferred form the cap may have a radially inwardly coaxially positioned wall which is positioned adjacent the surface of the cylindrical contact member opposite the slotted peripheral surface of the cap such that the inner wall will shift the position of the conductor on the inner surface of the contact member upon rotation of the cap member but not define an interference fit so tight with the contact member as to sever the insulation or wire of the conductor at the edge of the exit opening. The inner wall will actually form a band in the conductor between the IDC slot and the perforation in the contact member.

The terminal thus comprises a cylindrical contact member having an open mouthed slotted conductor insulation displacing slot and a conductor exit perforation generally diagonally disposed to the mouth of the slot, and a cap positioned coaxially and rotatable in relationship to the contact member with a first wire receiving opening located to register with the mouth of the slot, a wall having a groove interior of the contact member and a slotted exit passageway formed to cooperate with the exit perforation to permit relative rotation of said cap to make a wire connection to said contact member and to place a 90° bend the wire and wedge the same between the base of the groove in the wall and the interior of the contact member to afford strain relief. Also, the interior wall will shift the wire with respect to the exit perforation. The cap and contact member have cooperating stop means to restrict the rotation of the cap member relative to said contact member. The contact member has a probe engaging contact tab within the periphery thereof and the cap has an opening in the top to access a probe to the contact tab.

The contact used in this terminal has a second bifurcate spring compression reserve contact element extending from the end thereof opposite the cap and below the base of the terminal block mounting a plurality of the terminals in rows and columns.

The contact element of the present invention employs a longitudinally slit tubular or sleeve like contact element. However, the insulated wire is brought into electrically conductive contact with the element by a twisting rather than a thrusting motion; no special tools are required; and the completed connection, while being fully accessible for testing by a probe through the cap, is protected against casual or accidental contact.

BRIEF DESCRIPTION OF THE DRAWING

The present invention will be further described with reference to the accompanying drawing wherein.

DESCRIPTION OF THE PREFERRED EMBODIMENT

Figure 1:
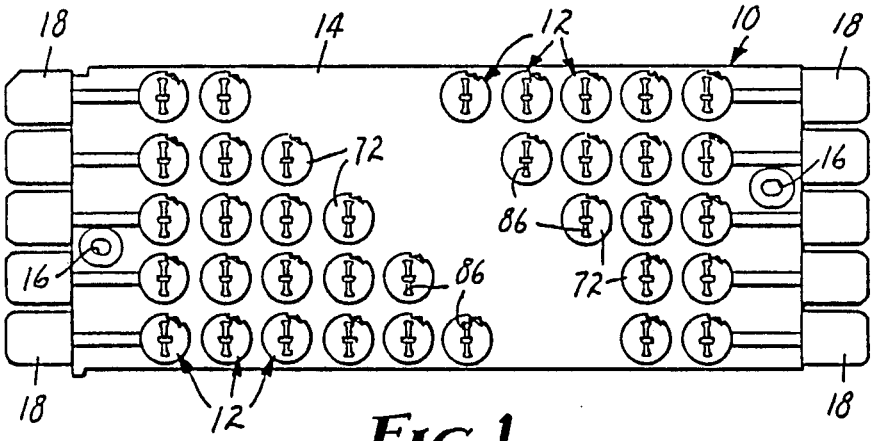
FIG. 1 is a plan view of a cross connect module comprising the terminals of the invention.
Figure 3:
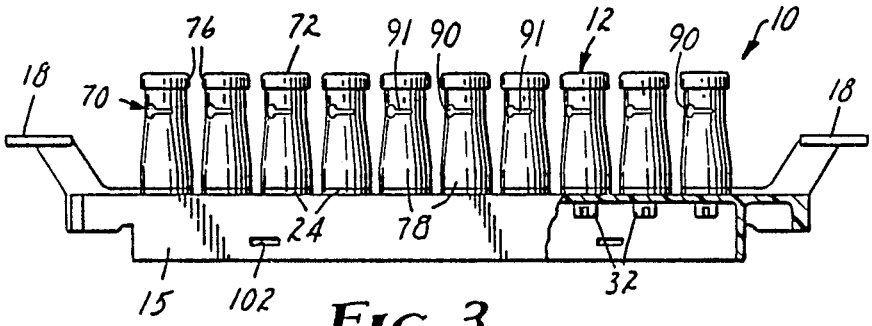
FIG. 3 is a side elevation, with a portion cut away, of the module of FIG. 1.
Figure 2:
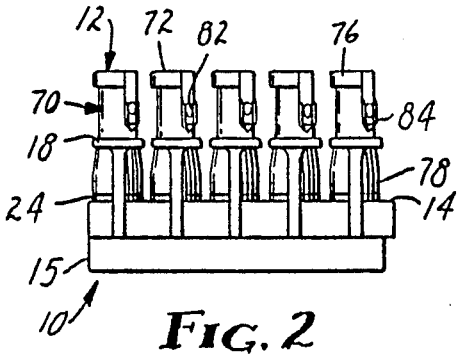
FIG. 2 is an end elevation.
Figure 4:
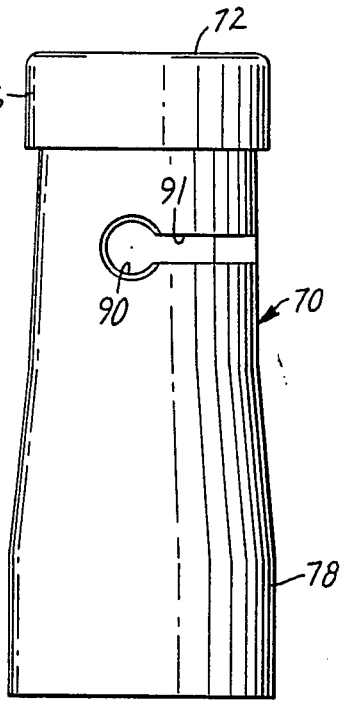
FIG. 4 is a side elevational view of one cap constructed according to the present invention.

The module 10 of FIGS. 1-3 will be seen to include 50 separate terminals 12, disposed in five rows and ten columns. A similar module is illustrated in U.S. Pat. No. 4,431,247 which describes a base and tubular contact member, the description of which are incorporated by reference herein. The base 14, having lower walls 15, is dimensioned for mounting against a support within a cabinet by means of screws inserted through holes 16. Pads 18 at the ends of the base are provided for supporting and arranging individual wires or bundles of wires which are to be connected. Color coding is customarily added for ease of identification of tip and ring positions.

Figure 7:
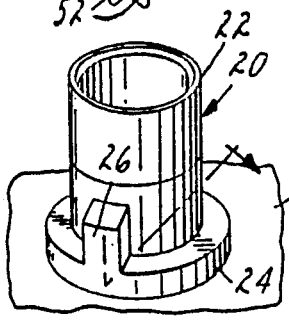

The terminal 12 includes a body 20, FIG. 7, formed as a part of the base 14. It consists of a cup shaped segment having a slightly conical outer upper surface 22 and which is partially surrounded by crescent-like wall 24, the two of which are joined by a stop 26 and are spaced apart to receive the base of a cap 70 to be hereinafter described. A stop 26 extends upwardly from the base 14, and a detent 28, see FIG. 8, protrudes inwardly from the opposite lower inner surface. The bottom of the cup, forming a portion of the base 14, is perforate at arcuate perforation 30 and carries raised blocks 32 and 34 on the outer surface. Blocks 32 include opposing extensions 36, only one pair of which are shown, which extensions define a wire retaining pathway in alignment with the center of the arcuate perforation 30.

Figure 9:
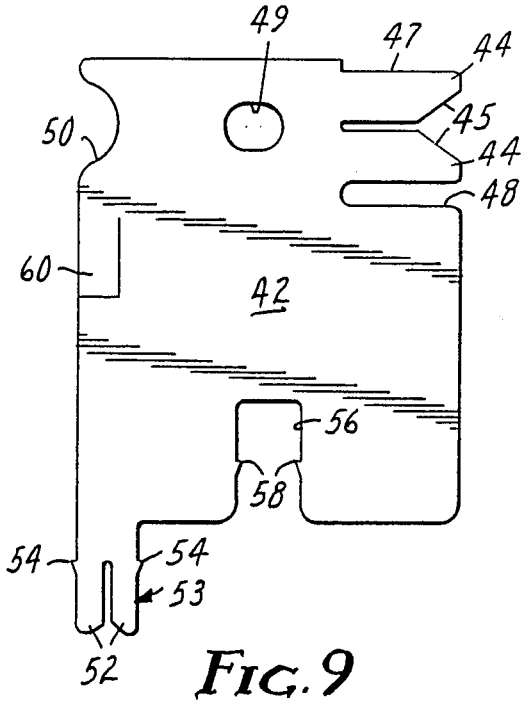
FIG. 9 is a plan view of the blank for the contact element of FIG. 6.
Figure 6:
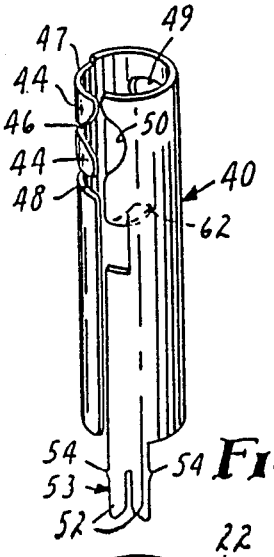

The tubular or generally cylindrical contact member 40 of FIG. 6 is formed from a flat blank 42 as shown in FIG. 9. It has a pair of laterally directed contact fingers 44 defining an open mouthed wire receiving slot 46. A marginal space or partial slot 47 above, and a second slot 48 below, serve to isolate the resulting bifurcate contact element and to permit necessary slight deflection of the contact fingers during insertion of a conductor in slot 46 to make an insulation displacing wire connection with the contact member. Perforation 49, and semicircular concavity 50 together with the open mouth of the contact element between the angled inner edges 45 at the tips of fingers 44, form a transverse passageway for a wire generally diametrically through the tubular connecting member 40.

A second pair of contact fingers 52 depending from the lower edge of the member 40 and forming an extended second bifurcate contact element 53 extends through the arcuate opening 30 in the base and against and beyond the block 34. Angular projections 54 on the longitudinal edges of the extension penetrate the walls of the opening 30 and anchor the member 40 to the base.

The member 40 is further slotted from the lower edge to form a wide slot 56. The side edges defining the slot carry angular anchor projections 58. The inner detent of the body 20 fits snugly within the slot 56 and prevents rotation of the contact member 40 in relationship to the body. The projections 58 penetrate the edges of the detent 28 and assist in anchoring the member against removal.

Figure 8:
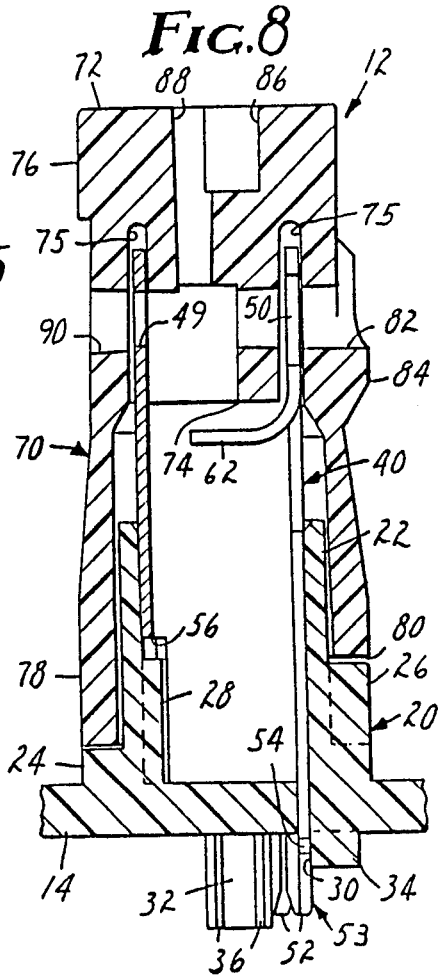
FIG. 8 is a longitudinal cross section of the assembled terminal of FIGS. 5–7 taken approximately at section 8—8 of FIGS. 5–7.

A tongue 60 forming a part of the edge of the blank 42 beneath the concavity 50 is bent inwardly to form contact tab 62 extending horizontally across the center of the cylindrical connecting member 40, as shown in FIG. 8.

The cap 70 is also generally cylindrical, with a top wall 72 from which depends a circular wall segment 74, leaving an annular space 75. The cap fits over the upper portion of the tubular member 40 which extends into the annular space 75, and over the tubular shell of the cup shaped segment of the body 20. Upper and lower portions 76, 78 of the cap are radially enlarged for increased strength. A segment of the lower rim is omitted, leaving a space 80 which permits the cap to fit over the step 26 between the body 20 and the wall 24 and to be rotated thereon through approximately one quarter turn.

The cap, including the wall segment 74, is laterally perforate at the level of the transverse passageway in the member 40, to provide a wire receiving channel 82. The outer surface of the ca is enlarged and chamfered below the entrance to this channel, as at boss 84, so as to facilitate the insertion of a wire end into the channel.

The top of the cap is slotted and perforate. As illustrated in FIG. 1, the slot 86 is in line with the column transverse to the base 14 when the connector is open to receive a wire end, with the right edge of the lower cap portion 78 against the stop 26. The perforation 8 is parallel to and closely adjacent the longitudinal axis; it extends through the top wall 72 and in line with the contact tab 62. An exit opening 90 in the cap 70 allows the conductor to pass through the perforation 49 and the opposite side of the cap. The opening 90 communicates with a slot 91, larger than the conductor, which slot extends from the opening 90 about one quarter turn in a direction corresponding to the space 80 such that rotation of the cap 70 from the stop 26 permits the cap to rotate without driving the conductor against an edge of the perforation 49.

Cross connect wires of 22 or 24 AWG (0.65 or 0.5 mm) are connected to the individual terminals by inserting the wire and through the aperture 82 and twisting the cap through the arc permitted by the stop 26. The wire is forced between the fingers 44 which displace the insulation and make spring compression reserve contact with the conductor. The remaining free end extends through perforation 49 and the slot 91. Twisting action is accomplished with an ordinary screwdriver, the bit fitting into the slot 86. If contact with the connection is desired, as for testing purposes, the aperture 88 provides for access of a suitable test probe to the tab 62. When connection beyond the terminal from opening 82 or slot 91 is no longer desired, the conductor is snipped off close to the cap 70 at either opening 82 or slot 91.

Figure 10:
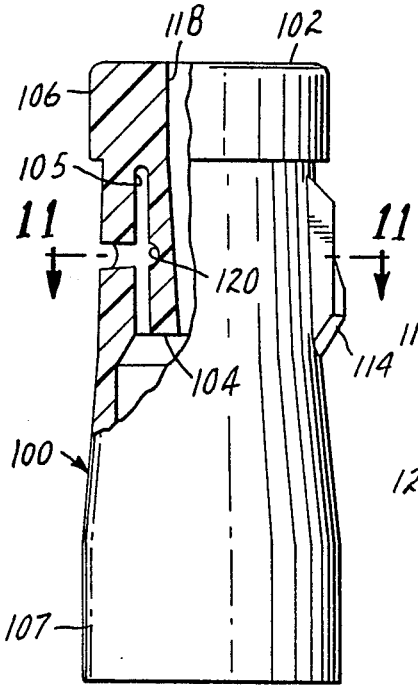
FIG. 10 is a side view of an alternative embodiment of the cap, partially in section to illustrate the interior structure.
Figure 11:
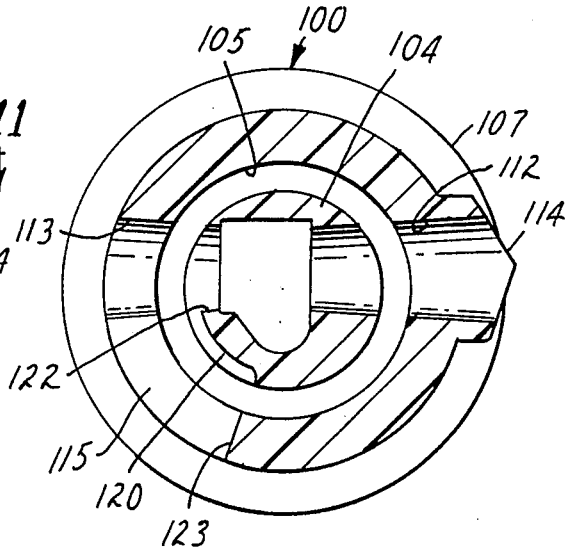
FIG. 11, is a fragmentary view partially in section taken along the line 11—11 of FIG. 10.
Figure 5:
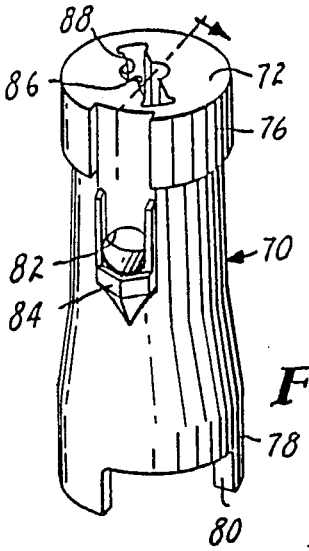
FIGS. 5, 6, and 7 are perspective views, in axial alignment, of the cap, illustrating the side of the cap opposite that of FIG. 4 or 10, the contact element, and body respectively of one of the terminals of the module of FIG. 1.

An alternative embodiment of the cap 70 is illustrated in FIGS. 10 and 11 and is generally designated 100. The cap 100 is also generally cylindrical, with an upper end 102 from which depends a central column 104, leaving an annular space 105 and defining with a hole 118 an annular wall disposed adjacent the inner surface of the tubular member 40. The cap 100 fits over the upper portion of the tabular member 40 as does cap 70, which extends into the annular space 75, and over the tubular shell of the body 20. Upper and lower portions 106 and 107 of the cap are radially enlarged for increased strength. A segment of the lower portion 107 is omitted to leave a space (not shown) similar to space 80 which permits the cap 100 to fit over the stop 26 between the body 20 and the wall 24 and to be rotated in relationship to the member 40, body 20 and stop 26 approximately one quarter turn.

The cap 100, including the central column 104, is laterally perforate at the level of the transverse passageway in the member 40, to provide a wire receiving channel 112. The outer surface of the cap is enlarged and chamfered below the entrance to this channel, as at boss 114, so as to facilitate the insertion of a wire and into the channel. On the side of the cap 100 opposite the entrance to the wire receiving channel 112 is the exit opening 113 joined to a slot 115 in the outer side wall. Slot 115 corresponds to slot 91. Opposite the slot 115 on the exterior of the annular wall formed by the central column 104 is a groove 120 extending from the channel 112 about the annular wall. The groove 120 is arcuate in cross section and is large enough to receive a conductor and permits the conductor to be driven by a wall portion 122 of the central column 104 past the perforation 49 to a position away from the longitudinal axis of the contact member 40, between the annular wall and the contact member and then out the slot 115 adjacent its end wall 123. Thus, the nearly 90 degree bend in the wire from the area of connection between the fingers 44, the edge 122 of the central column 104 and the wall 123 of slot 115 displaces the conductor from blocking a probe passed through hole 118 from reaching a contact tab 62. The bend in the wire also affords strain relief together with the fact the wire is wedged between the base of the groove 120 and the interior surface of the contact member 40 increasing further the resistance to pull out. When the connecting member strips some insulation at bend near wall 122, additional contact is made with the connecting member.

The combination of cap 70 or cap 100 and contact member 40 is generally useful in the connector and terminal art, but offers particular advantages when incorporated in multiple terminal arrays as shown in FIG. 1 and which are offered in partly prewired or preterminated condition as will now be described.

With the structure shown in FIGS. 1 through 3 and 8, wire segments are forced into the contacts 53 and between opposing extensions 36, using a suitable insertion tool. Any excess of wire is simultaneously cut off by knife action of the tool against the block 34. Somewhat analogous tool design and action is shown in U.S. Pat. No. 4,210,378. The free ends of the wire segments are bundled together, and the connections are sealed in place by embedding with a suitable sealant applied over the bottom surface of the base 14 and at least partially filling the space defined by the walls 15.

Pretermination may also be accomplished during assembly of the terminals. A wire segment is forced into position against the lower surface of the base 14, within the channel between the blocks 32 and extensions 36, and across the arcuate perforation 30, and held in place with a supporting jig while the connecting member 40 is inserted through the body 20. The several wires are then bundled and the connections embedded as already described.

Having thus described the invention with reference to two specific embodiments, it is to be understood that changes may be made in the terminal without departing from the present invention as defined by the appended claims.

We claim:

1. An electrical terminal comprising:

a cylindrical contact member having an open longitudinal seam, transversely slotted from one side of said seam to form and isolate an open mouthed bifurcate insulation displacing contact element, and having a perforation opposite said seam to form a wire exit passage; and a cap member rotatably associated with and positioned about said cylindrical member, said cap having an entrance opening in line with said open mouthed bifurcate contact element for receiving a wire and forcing said wire into said contact element and a slot aligned with and adjacent said perforation to allow passage of a said wire from said perforation.

2. Terminal of claim 1 wherein said cap is provided with an arcuate wall disposed within said cap which is coaxial therewith to be disposed within said cylindrical contact member, said annular wall having an opening in line with said entrance opening to assist in forcing a said wire into contact with said bifurcate contact element.

3. Terminal of claim 2 wherein said arcuate wall extends around the interior of said cylindrical member and has an opening therein opposite said opening adjacent said entrance opening which communicates with a wire receiving groove extending about the outer periphery of the arcuate wall and opposite the slot in the cap member.

* * * * *

UNITED STATES PATENT AND TRADEMARK OFFICE

CERTIFICATE OF CORRECTION

PATENT NO. : 4,795,363

DATED : January 3, 1989

INVENTOR(S) : Richard J. Scherer, Austin, Texas;
William G. Witt, Georgetown, Texas It is certified that error appears in the above-identified patent and that said Letters Patent is hereby corrected as shown below:

Col. 1, line 38, "b" should read --be--.

Col. 2, line 8, "band" should read --bend--.

Col. 3, line 60, after "inner detent", insert --28--.

Col. 4, line 12, "step" should read --stop--.

Col. 4, line 18, "ca" should read --cap--.

Col. 4, line 25, "8" to --88--.

Signed and Sealed this

Fifteenth Day of August, 1989

*Attest:*

*Attesting Officer*

DONALD J. QUIGG

*Commissioner of Patents and Trademarks*